US005655654A

United States Patent [19]

Broskow

[11] Patent Number: 5,655,654

[45] Date of Patent: Aug. 12, 1997

[54] TOP LIFT CONTAINER CARRIER WITH EXTENDABLE CARRIER

[75] Inventor: James A. Broskow, Buffalo Grove, Ill.

[73] Assignee: Illinois Tool Works Inc., Glenview, Ill.

[21] Appl. No.: 489,339

[22] Filed: Jun. 12, 1995

Related U.S. Application Data

[63] Continuation-in-part of Ser. No. 391,137, Feb. 21, 1995, Pat. No. 5,593,026.

[51] Int. Cl.[6] ..... B65D 71/00

[52] U.S. Cl. ..... 206/150; 206/151; 294/87.2

[58] Field of Search ..... 206/150, 151, 206/158, 161, 427; 294/87.2

[56] References Cited

U.S. PATENT DOCUMENTS

| | | | |
|---|---|---|---|
| 2,994,426 | 8/1961 | Biesecker et al. | 206/150 |
| 3,232,422 | 2/1966 | Whyte | 206/150 |
| 3,268,070 | 8/1966 | Cunningham | 206/150 |
| 3,269,530 | 8/1966 | Wanderer | 206/150 |
| 3,307,321 | 3/1967 | Beart | 206/150 X |
| 3,383,827 | 5/1968 | Schaich | 206/158 X |
| 3,608,949 | 9/1971 | Owen | 206/150 X |
| 3,868,140 | 2/1975 | Gordon . | |
| 4,109,787 | 8/1978 | Klygis et al. | 206/150 |
| 4,545,480 | 10/1985 | Klygis | 206/151 |
| 4,850,479 | 7/1989 | Bird | 206/150 |
| 5,060,999 | 10/1991 | Marvin | 294/87.2 |
| 5,098,144 | 3/1992 | Marvin | 294/87.2 |
| 5,115,910 | 5/1992 | Klygis et al. . | |

*Primary Examiner*—Bryon P. Gehman

*Attorney, Agent, or Firm*—Trexler, Bushnell, Giangiorgi & Blackstone, Ltd.

[57] ABSTRACT

A plastic carrier for carrying a plurality of containers, such as bottles, cans and the like, includes a novel handle portion which, at rest, does not substantially extend above the tops of the containers, but permits the handle portion to expand upwardly to extend beyond the tops of the containers for carrying purposes. The carrier includes container engaging portions, each of which includes bands which define apertures therein for engaging the side walls of the containers to hold the containers therein to form a package. The handle portion extends generally perpendicular to the container engaging portions when the carrier is applied to the containers. The handle portion has elbows which generally straighten when the handle portion is expanded. A perforation line may be included in the handle portion to separate the strap portions from each other when torn.

16 Claims, 3 Drawing Sheets

TOP LIFT CONTAINER CARRIER WITH EXTENDABLE CARRIER

This application is a continuation-in-part of Ser. No. 08/391,137 filed Feb. 21, 1995 entitled "Ring Container Multipack With Perforated Tear Strip For Container Removal", now U.S. Pat. No. 5,593,026.

BACKGROUND OF THE INVENTION

This invention is generally directed to a novel carrier which secures containers, such as bottles or the like, together into a package and has a handle, which at rest, does not substantially extend above the tops of the containers, but permits the handle to expand upwardly to extend beyond the tops of the containers for carrying purposes.

Currently, several types of carriers can be found in the art for securing containers together into a package. One example is a typical six-pack carrier which is formed from a flat sheet of plastic material and is used to carry a plurality of cans. A plurality of apertures are provided, usually in two rows, in the sheet and each aperture holds a can therein. The carrier is secured to the top of each can so that the carrier is positioned slightly below the plane defined by the tops of the cans. The carrier includes finger holes therethrough between the rows so that a consumer can insert his or her fingers therethrough to carry the package.

When the package is formed in this manner, a consumer can easily place his or her fingers through the finger holes and carry the package. When this type of carrier is positioned on containers, such as bottles or the like, at a position along the side wall of the containers, however, the package cannot be easily carried in this manner. A consumer must insert his or her hand down into the package to access the finger holes. If the persons' hand is too large to fit between the rows of containers, the person may not be able to access the finger holes.

Handles have been added to carriers in this type of packaging so that the consumer does not have to insert his or her hand into the package to the level of the carrier. The handle extends upwardly in the package and generally perpendicular to the flat carrier with the top of the handle being generally flush with the tops of the containers. One problem that arises with this type of carrier is that the consumers' hand must still be inserted into the package to grasp the handle for carrying purposes.

The present invention presents a novel handle for a carrier which overcomes or minimizes the problems presented by the prior art and presents several other novel advantages and features.

OBJECTS AND SUMMARY OF THE INVENTION

A general object of the present invention is to provide a novel plastic carrier for carrying a plurality of containers, such as bottles, cans or the like, which has a novel handle which, at rest, does not substantially extend above the tops of the containers, but permits the handle to expand upwardly to extend beyond the tops of the containers for carrying purposes.

Another general object of the present invention is to provide a novel plastic carrier for carrying a plurality of containers, such as bottles, cans or the like, which includes a novel handle having elbows which create a connection portion for adjacent interconnected carriers so that the carriers can be easily and quickly wound into reels or rolls and easily handled.

A further object of the present invention is to provide a carrier which is sturdy and can be easily carried by a consumer.

Briefly, and in accordance with the foregoing, the present invention discloses a carrier for carrying a plurality of containers, such as bottles, cans and the like, which includes a novel handle portion which, when the package is not being carried by a consumer, does not substantially extend above the tops of the containers, but permits the handle portion to expand upwardly to extend beyond the tops of the containers for carrying purposes. The carrier includes container engaging portions, each of which includes annular rings or bands which define apertures therein for engaging the side walls of the containers to hold the containers therein to form a package. The handle extends upwardly and generally perpendicular to the container engaging portions when the carrier is engaged with containers.

Each ring or band has an inner margin portion, an outer margin portion and side margin portions. The inner margin portions of adjacent bands are joined together at a joined portion. The side margin portions of adjacent bands are integrally formed with each other.

The handle portion of the carrier of the present invention is formed from a generally U-shaped grip portion and a plurality of angled or bent strap portions which integrally connect the grip portion of the handle portion to the joined portion. When the carrier is lifted by a consumer so that the package can be carried, the strap portions generally straighten and permit the handle portion to expand upwardly so that the grip portion of handle portion extends beyond the tops of the containers.

The handle portion in one embodiment of the novel carrier is formed from two sets of straps which are connected to each other along a perforation line. When the package is carried by a consumer, the first and second sets of straps split apart from each other along the perforation line and generally straighten to permit the handle portion to expand upwardly so that the grip portion of the handle portion extends beyond the tops of the containers.

The outermost extents of the handle portion and the container engaging portions provide attachment regions for attaching adjacent interconnected like carriers thereto. This allows a plurality of flat carriers to be easily handled. When the carriers are flat and are attached to each other, the carriers can be wound onto a reel or otherwise easily handled.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE PREFERRED EMBODIMENT

Figure 1:
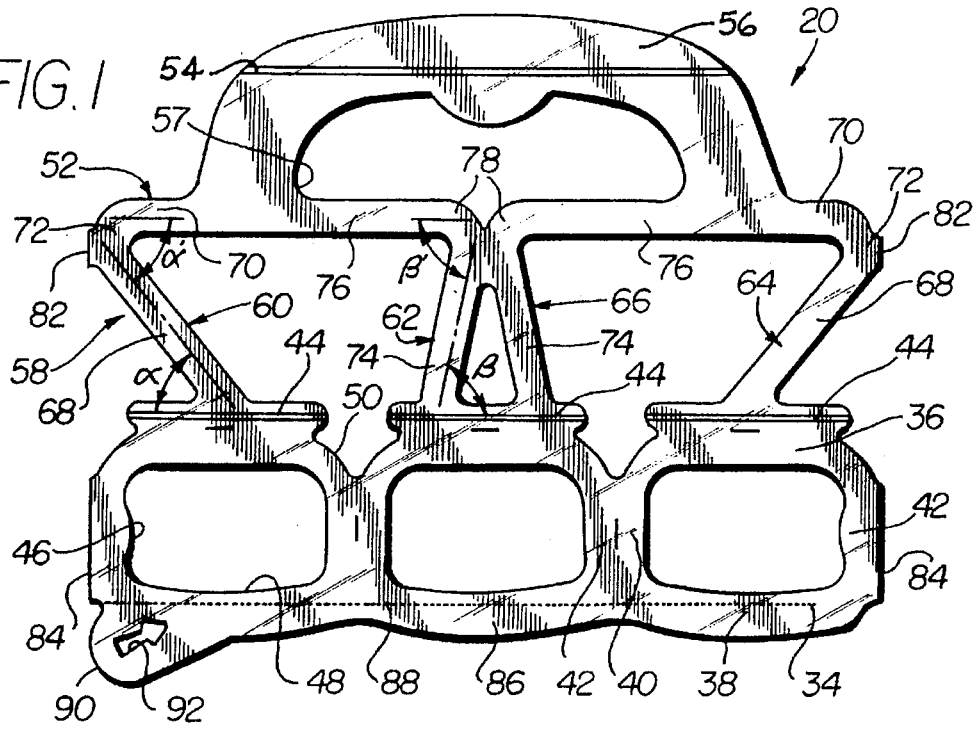
FIG. 1 is a side elevational view of a carrier which incorporates the features of a first embodiment of the invention.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

Figure 5:
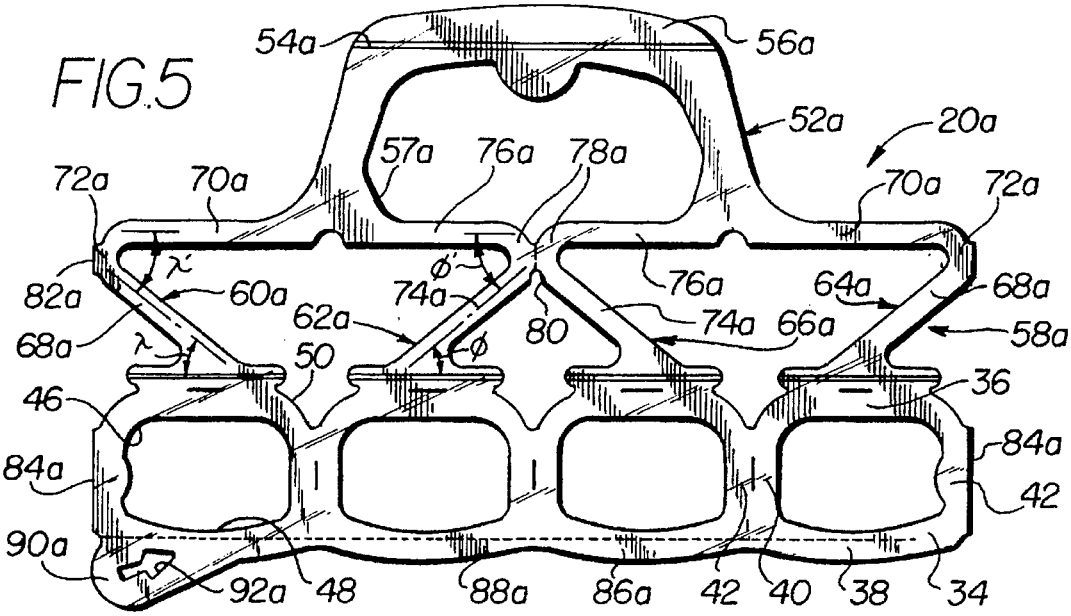
FIG. 5 is a side elevational view of a carrier which incorporates the features of a second embodiment of the invention.
Figure 6:
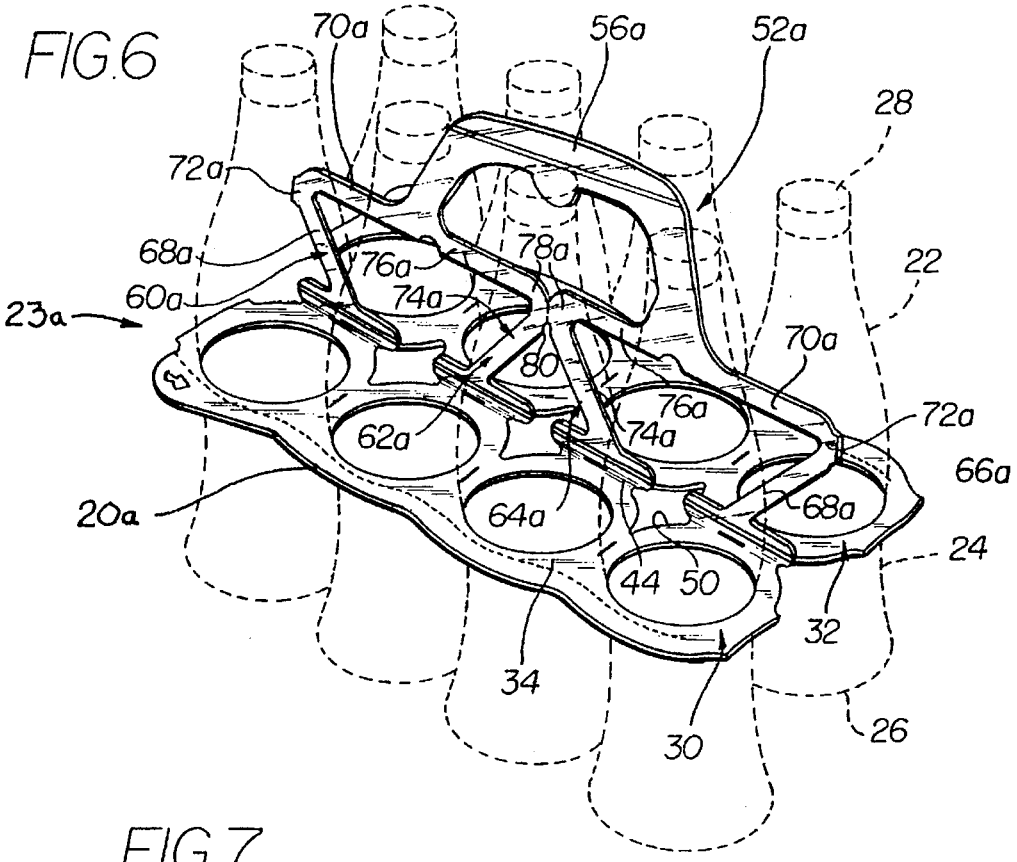
FIG. 6 is a perspective view of the carrier of FIG. 5 shown surrounding a plurality of containers, shown in phantom lines, to form a package with a handle portion of the carrier at an at rest position.
Figure 7:
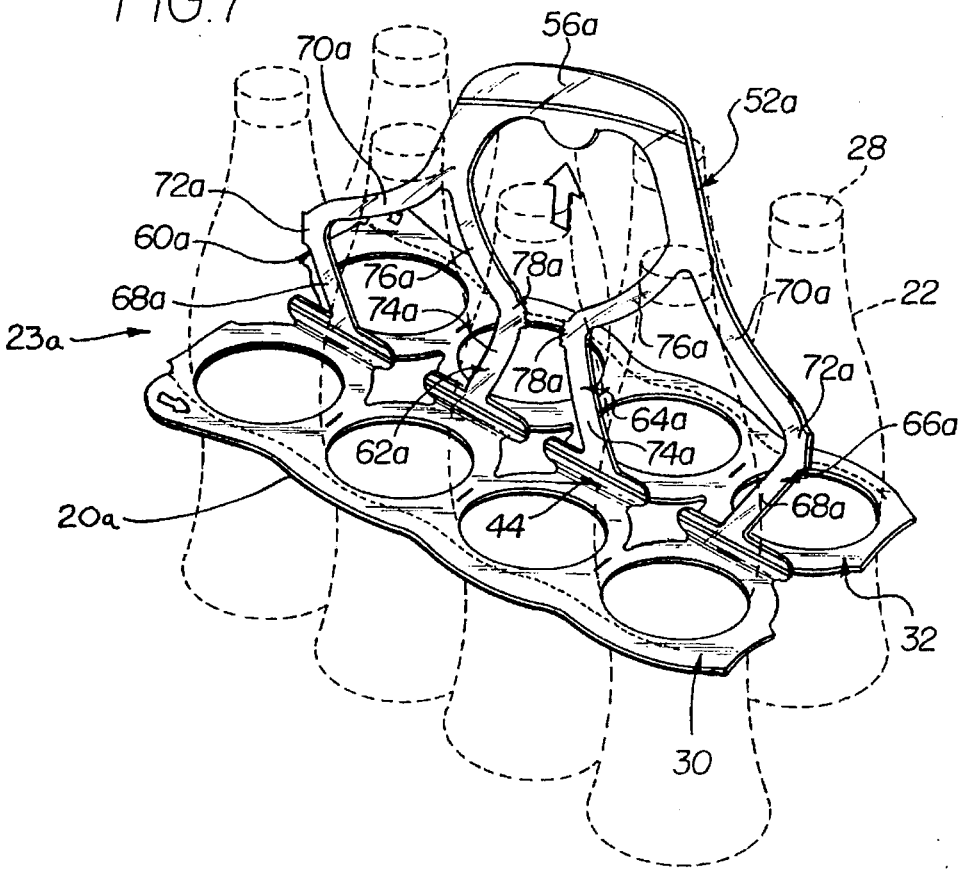
FIG. 7 is a perspective view of the carrier of FIG. 5 shown surrounding a plurality of containers, shown in phantom lines, to form a package with a handle portion of the carrier at a carrying position.

As shown in the drawings, a multi-packaging device or carrier device 20, 20*a*, constructed according to the teachings of the present invention, is shown holding a plurality of containers 22. A first embodiment of the carrier 20 is shown in FIGS. 1–4 and a second embodiment of the carrier 20*a* is shown in FIGS. 5–7. Like elements in each embodiment are denoted by like reference numerals with the like elements of the second embodiment having the suffix "a" thereafter.

Figure 2:
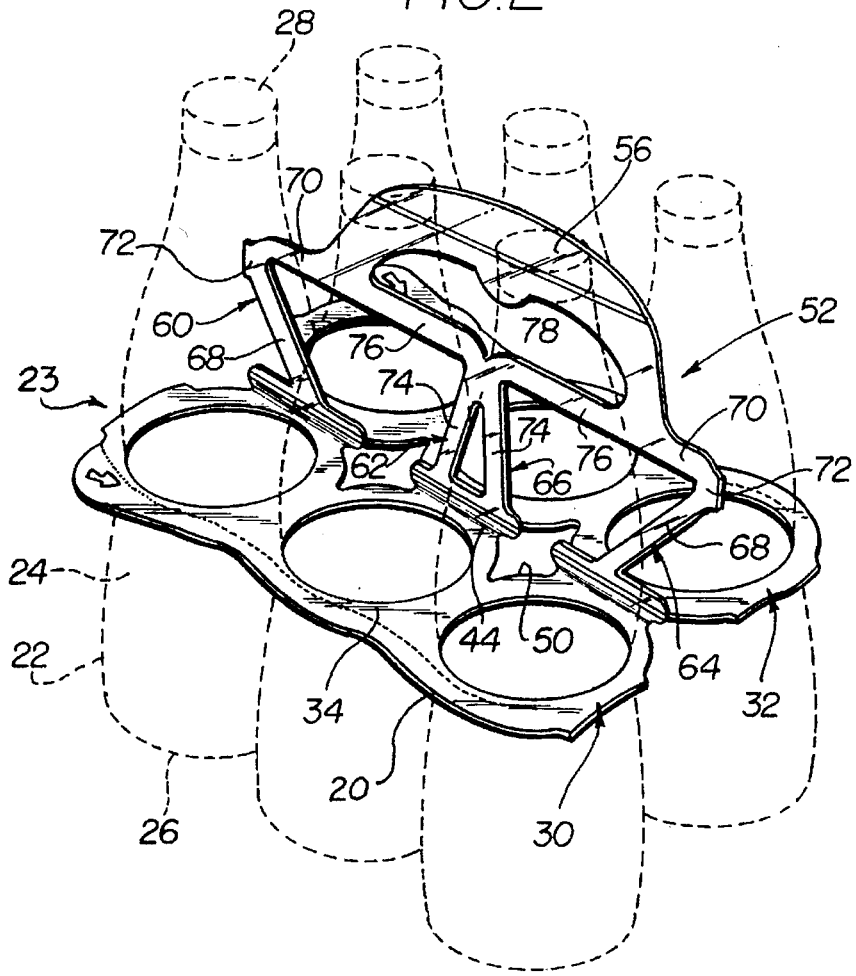
FIG. 2 is a perspective view of the carrier of FIG. 1 shown surrounding a plurality of containers, shown in phantom lines, to form a package with a handle portion of the carrier at an at rest position.
Figure 3:
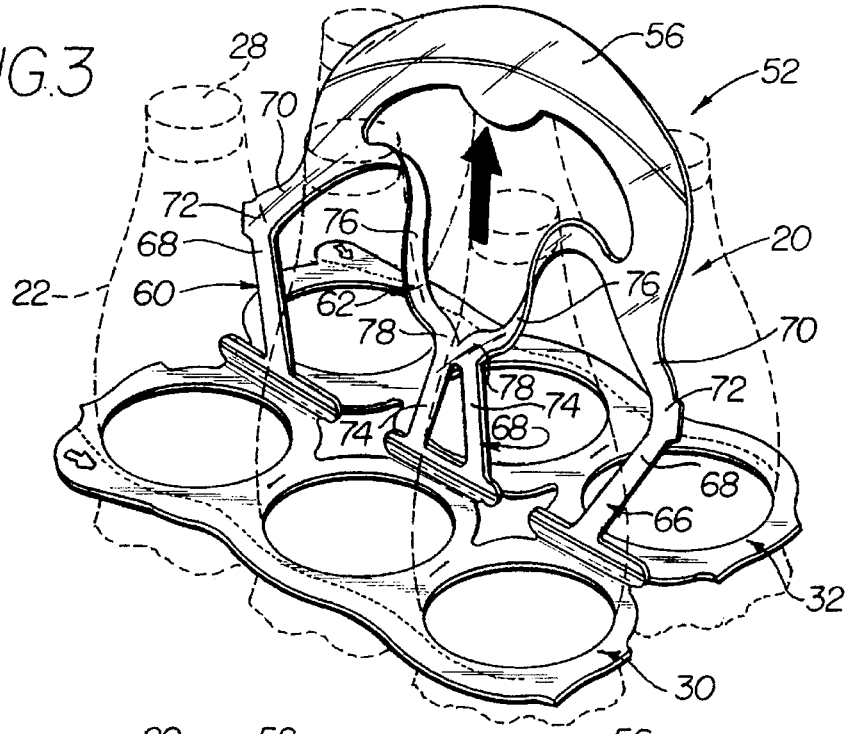
FIG. 3 is a perspective view of the carrier of FIG. 1 shown surrounding a plurality of containers, shown in phantom lines, to form a package with a handle portion of the carrier at a carrying position.

As shown in FIGS. 2 and 3, the first embodiment of the carrier device 20, constructed in accordance with the teachings of the present invention, is used to hold and carry six bottles 22 to form a package 23. As shown in FIGS. 6 and 7, the second embodiment of the carrier device 20*a*, constructed in accordance with the teachings of the present invention, is used to hold and carry eight bottles 22 to form a package 23*a*. Each bottle 22 includes a side wall 24, a bottom wall 26 and a top or cap 28. It is to be understood that other types of containers can be carried by the carrier 20, 20*a*, such as cans and the like.

Each carrier 20, 20*a* is made of a suitable flexible, resilient, stretchable material, such as plastic. Preferably, the carrier 20, 20*a* is made of a low density polyethylene so that the carrier 20, 20*a* can be stretched over the containers 22 and conform to the side walls 24 of the containers 22. The carrier 20, 20*a* may be applied to the containers 22 by known means, for example, by the machines disclosed in U.S. Pat. No. 4,250,682 to Braun or U.S. Pat. No. 3,204,386 to Creed et al.

When the containers 22 are secured in a package arrangement by the carrier 20, 20*a*, the containers 22 are aligned in an array so to form two rows. As shown in FIG. 2 and 3, in the first embodiment of the carrier 20, each row has three bottles 22, and as shown in FIG. 3, in the second embodiment of the carrier 20*a*, each row has four bottles 22. It is to be understood that the carriers 20, 20*a* operates equally well with any number of containers 22.

Directing attention to the general structure of the embodiments of the carrier 20, 20*a*, the general structure is described with respect to the first embodiment of the carrier 20 for convenience in explanation. The second embodiment of the carrier 20*a* has a like structure except for the differences noted herein.

The carrier 20 includes container engaging portions 30, 32, each formed from a plurality of annular rings or bands 34. Each band 34 has an inner margin 36, an outer margin 38 and side margins 40, 42 which connect the inner margin 36 of each band 34 to the outer margin 38 of the same band 34. The side margins 40, 42 of adjacent bands 34 are integrally joined together so that the outer margins 38 of the bands 34 are continuous and uninterrupted along the length of the carrier 20.

The bands 34 are connected or joined together by a seam or a joined portion 44, as described herein, along the inner margins 36 of each band 34. The annular bands 34 define a plurality of shaped apertures 46 for securely holding the containers 22 therein. The outer margin 48 of each aperture 46 is slightly contoured for reasons described herein.

The container engaging portions 30, 32 freely extend from the joined portion 44. When the carrier 20 is not assembled with containers 22, the carrier 20 is flat and the joined portion lies in the same plane as the container engaging portions 30, 32. The joined portion 44 projects generally perpendicular to the plane of the container engaging portions 30, 32 when the carrier 20 is assembled with containers 22.

The joined portion 44 is formed by extruding a strip or layer of resilient, stretchable material (not shown), such as plastic, preferably low density polyethylene material, between the inner margins 36 of each annular band 34 and thereafter sufficiently melting and merging the inner margins 36 of the container engaging portions 22, 24 and the layer of extruded plastic together by known means, preferably by heat sealing and fusing the layers together, to form a strong, integral bond. The joined portion 44 is interrupted along its length by cutouts 50 which form apertures between the container engaging portions 30, 32. A method for forming the multi-package device or carrier device 20 of the present invention is disclosed in U.S. patent application Ser. No. 08/230,308 entitled "Container Carrier" and owned by the assignee herein and which disclosure is incorporated herein by reference.

Preferably, the carrier 20 is formed by joining two separate sheets of plastic material together at the joined portion 44. However, it is within the scope of the invention that a single sheet of plastic material may be used to form the carrier 20 by folding the sheet in half and applying a layer of plastic or otherwise fusing the sheets together to form the joined portion 44.

The carrier 20 includes an integral handle portion 52 which extends upwardly from the joined portion 44 of the carrier 20. Thus, when the carrier 20 is not assembled with containers 22, the carrier 20 is flat and the handle portion 52 lies in the same plane as the container engaging portions 30, 32. When the carrier 20 is assembled with containers 22, the handle portion 52 projects generally perpendicular to the plane of the container engaging portions 30, 32.

The handle portion 52 is formed from the two sheets that are used to form the carrier 20. A bond 54, formed by heat sealing the sheets together or by extruding a layer of plastic material between the sheets, is provided along an upper portion of the handle portion 52 to prevent the sheets which form the handle portion 52 from separating. This also aids in making the handle portion 52 easy to grasp by a consumer.

Now directing attention to the specifics of the first embodiment of the carrier 20, shown in FIGS. 1–4, and which is preferably used to carry six containers 22, the handle portion 52 is formed from a generally U-shaped grip portion 56, which a consumer grasps with his or her hand to carry the package 23, and a plurality of angled or bent strap portions 58 which integrally connect the grip portion 56 of the handle portion 52 to the joined portion 44. The carrier 20 has a first set of straps which is formed from an outer strap portion 60 and an inner strap portion 62 and a second set of straps which is formed from an outer strap portion 64 and an inner strap portion 66. Both sets of strap portions 60, 62; 64, 66 are formed from both sheets of the handle portion 52. The sets of straps 60, 62; 64, 66 are integrally connected together as described herein. The U-shaped grip portion 56 is connected to the bent strap portions at a location 57 which can vary depending on the desired height of the handle when elevated or expanded in accordance with this invention.

When the carrier 20 is attached to containers 22 and when the package 23 is not being carried by a consumer, the handle portion 52 is at the "at rest" position and the grip portion 56 of the handle portion 52 does not substantially extend above the tops 28 of the containers 22 as shown in FIG. 2. The strap portions 60, 62; 64, 66 permit the handle portion 52 to expand upwardly so that the grip portion 56 of the handle portion 52 extends beyond the tops 28 of the containers 22 for carrying purposes, as shown in FIG. 3 and as described herein.

The outer strap portions 60, 64 each have a first leg 68 which extends upwardly from the joined portion 44 above the outermost aperture of the carrier 20, respectively, at angle $\alpha$ relative to the joined portion 44 and each of which diverge outwardly from each other. Each first leg 68 is integral with the joined portion 44. Each outer strap portion 60, 64 has a second leg 70 which is integral with and disposed at an angle $\alpha'$ relative to the first leg 68 and joined to the first leg 68 at an elbow portion 72. The second leg 70 is integral with the grip portion 56. At rest, the second leg 70 is generally parallel to the joined portion 44.

The inner strap portions 62, 66 each have a first leg 74 which extends upwardly from the joined portion 44 above the center aperture of the carrier 20 at an angle $\beta$ relative to the joined portion 44 and each of which converge inwardly towards each other. The first leg 74 is integral with the joined portion 44. The inner strap portions 62, 66 have a second leg 76 which is integral with and disposed at an angle $\beta'$ relative to the first leg 74 and joined to the first leg 74 at an elbow portion 78. The second leg 76 is integral with the grip portion 56. At rest, the second leg 76 is parallel to the joined portion 44.

The elbow portions 78 of the inner strap portions 62, 66 are integrally joined together. Thus, the handle portion 52 is integrally formed.

In the preferred embodiment, $\alpha$ and $\alpha'$ are congruent and 50°, while $\beta$ and $\beta'$ are congruent and 80°. These angles should be acute but the exact angle can be varied depending on the extent of elevation desired and/or the amount of relative stress on the various straps desired. Also, the location of connection points 57 to the bent strap portions will determine the actual angles.

The junctions between the grip portion 56 and the legs 70, 76 are located so as to be spaced from the elbow portions 72, 78 to promote flexing of the legs and upward extension of the grip portion as described below. In other words, the strap portions 60, 62, 64, 66 extend in a zig-zag fashion from their junctions with the joined portion 44 to their junctions with the grip portions 56 for enabling the strap portions to straighten out when the package is lifted by the handle.

When a consumer desires to carry the package 23 by the handle portion 52, the consumer grasps the grip portion 56 of the handle portion 52. As the package 23 is lifted by the consumer, the sets of straps 60, 62; 64, 66 flex due to the handle portion 52 being pulled upwardly and the weight of the containers 22 counteracting the upward force. The handle portion 52 flexes and the strap portions 60, 62; 64, 66 generally straighten, as shown in FIG. 3, so that the handle portion 52 expands upwardly which causes the grip portion 56 of the handle portion 52 to extend beyond the tops 28 of the containers 22. When the strap portions 60, 62; 64, 66 generally straighten, the first and second legs 68, 70; 74, 76 of each strap portion 60, 62; 64, 66, respectively, generally form a straight line. Due to the elbow portions 72, 78, the first and second legs 68, 70; 74, 76 do not completely straighten. When the handle portion 52 of the package 23 is released, the handle portion 52 generally reassumes its initial shape.

Now directing attention to the specifics of the second embodiment of the carrier **20*a*, shown in FIGS. 5–7, and which is preferably used to carry eight containers 22, the handle portion 52*a* is similar to that of the first embodiment. The handle portion 52*a* is formed from a generally U-shaped grip portion 56*a* which a consumer grasps by his or her hand to carry the package 23 and a plurality of angled or bent strap portions 58*a* which integrally connect the grip portion 56*a* of the handle portion 52*a* to the joined portion 44. The U-shaped grip portion 56*a* is connected to the bent strap portions at a location 57*a* which can vary depending on the desired height of the handle when elevated or expanded in accordance with this invention. Each strap portion 58*a* is formed from both sheets of the handle portion 52*a***.

The carrier **20*a* has a first set of straps which is formed from an outer strap portion 60*a* and an inner strap portion 62*a* and a second set of straps which is formed from an outer strap portion 64*a* and an inner strap portion 66*a*. The first and second sets of straps 60*a*, 62*a*; 64*a*, 66*a* are connected to each other along a perforation line 80** as described herein.

Like that of the first embodiment and as shown in FIG. 6, when the carrier **20*a* is attached to containers 22 and when the package 23*a* is not being carried by a consumer, the handle portion 52*a* is at the "at rest" position and the grip portion 56*a* of the handle portion 52*a* does not substantially extend above the tops 28 of the containers 22. When the package 23*a* is lifted by a consumer, the handle portion 52*a* stretches and the perforation line 80 tears. This splits the first and second sets of straps 60*a*, 62*a*; 64*a*, 66*a* apart from each other so that the strap portions 60*a*, 62*a*; 64*a*, 66*a* can generally straighten to permit the handle portion 52*a* to expand upwardly so that the grip portion 56*a* of the handle portion 52*a* can extend beyond the tops 28 of the containers 22, as shown in FIG. 7** and as described herein.

The outer strap portions **60*a*, 64*a* each have a first leg 68*a* which extends upwardly from the joined portion 44 above the outermost apertures of the carrier 20*a*, respectively, at angle $\lambda$ relative to the joined portion 44 and diverge away from each other. Each first leg 68*a* is integral with the joined portion 44. The outer strap portions 60*a*, 64*a* each have a second leg 70*a* which is integral with and disposed at an angle $\lambda'$ relative to the first leg 68*a* and joined to the first leg 68*a* at an elbow portion 72*a*. The second leg 70*a* is integral with the grip portion 56*a*. At rest, the second leg 70*a* is parallel to the joined portion 44**.

The inner strap portions **62*a*, 66*a* each have a first leg 74*a* which extends upwardly from the joined portion 44 above the innermost apertures of the carrier 20*a* at an angle $\phi$ relative to the joined portion 44 and converge inwardly towards each other. The inner strap portions 62*a*, 66*a* each have a second leg 76*a* which is integral with and disposed at an angle $\phi'$ relative to the first leg 74*a* and joined to the first leg 74*a* at an elbow portion 78*a***. At rest, the second leg 76*a* is parallel to the joined portion 44. The elbow portions 72*a*, 78*a* of the inner strap portions 62*a*, 66*a* are joined together along the perforation line 80.

In the preferred embodiment, λ and λ' are congruent and 66°, while ϕ and ϕ' are congruent and 55°. These angles should be acute but the exact angle can be varied depending on the extent of elevation desired and/or the amount of relative stress on the various straps desired. Also, the location of connection points 57*a* to the bent strap portions will determine the actual angles.

The junctions between the grip portion 56 and the legs 70*a*, 76*a* are located so as to be spaced from the elbows 72*a*, 78*a* to promote flexing of the legs and upward extension of the grip portion 56*a* as described below. In other words, the strap portions 60*a*, 62*a*, 64*a*, 66*a* extend in a zig-zag fashion from their junctions with the joined portion 44 to their junctions with the grip portions 56*a* for enabling the strap portions to straighten out when the package is lifted by the handle.

When a consumer desires to carry the package 23*a* by the handle portion 52*a*, the consumer grasps the grip portion 56*a* of the handle portion 52*a*. As the package 23*a* is lifted by the consumer, the sets of straps 60*a*, 62*a*; 64*a*, 66*a* flex due to the handle portion 52*a* being pulled upwardly and the weight of the containers 22 counteracting the upward force. The handle portion 52*a* splits along the perforation line 80 to separate the sets of straps and the strap portions 60*a*, 62*a*; 64*a*, 66*a* of the handle portion 52*a* generally straighten, as shown in FIG. 7, so that the handle portion 52*a* expands upwardly causing the grip portion 56*a* of the handle portion 52*a* to extend beyond the tops 28 of the containers 22. When the strap portions 60*a*, 62*a*; 64*a*, 66*a* generally straighten, the first and second legs 68*a*, 70*a*; 74*a*, 76*a* of each strap portion 60*a*, 62*a*; 64*a*, 66*a* generally form a straight line. Due to the elbow portions 72*a*, 78*a*, the first and second legs 68*a*, 70*a*; 74*a*, 76*a* do not completely straighten. When the handle portion 52*a* of the package 23*a* is released, the handle portion 52*a* generally reassumes its initial shape.

Figure 4:
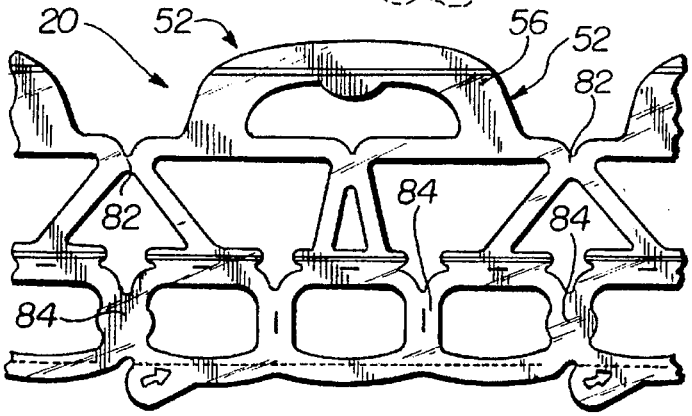
FIG. 4 is a partial elevational view of a plurality of flat carriers embodying features of the present invention and which are connected together.

As shown in FIG. 4, when the carriers 20 are manufactured, the carriers 20 are integrally attached together before being separated into individual carriers. The outermost ends 82 of the handle portion 52 and the outermost ends 84 of the container engaging portions 30, 32 provide attachment regions for attaching adjacent interconnected like carriers thereto as shown in FIG. 4. This allows a plurality of flat carriers 20 to be easily handled. When the carriers 20 are flat and are attached to each other, the carriers 20 can be wound onto a reel into a roll or otherwise easily handled. To form an individual carrier 20, the carriers are cut apart from each other by suitable means. The embodiment of the carrier 20*a* shown in FIGS. 5–7 includes attachment regions 82, 84 like that of the carrier 20 shown in the first embodiment and can be handled in the same manner.

Each carrier device 20, 20*a* can include tear strips 86, 86*a*. Each tear strip 86, 86*a* is formed from a substantial portion of the continuous outer margins 38 of the bands 34 and is separated from the remainder of the carrier device 20, 20*a* by a fine, linear perforation line 88, which, when torn, separates the outer margins 38 of the carrier device 20, 20*a* into a first portion, which is formed from the remaining portion of the outer margin of the carrier and a second portion, which is formed from the tear strip 86, 86*a* itself. The strips 86, 86*a*, once separated from the remainder of the carrier 20, 20*a*, allow the containers 22 to be easily and quickly released from the carrier 20, 20*a*.

The perforation line 88 which separates the tear strip 86, 86*a* from the first portion may be formed from a series of spaced dots, or alternatively, a series of spaced short lines. Each dot in the perforation line 88 is separated from each other by a continuous, uninterrupted portion of the carrier 20, 20*a*. The perforation lines 88 do not significantly reduce package integrity while facilitating tearing and removal of the tear strips 86, 86*a* on each side of the carrier device 20, 20*a*. It is envisioned that an extruded bead of material could be used instead of the perforation line. The perforation line 88 is formed by suitable known means.

Each perforation line 88 starts at an end of the carrier device 20, 20*a* and preferably ends within the perimeter of the carrier device 20, 20*a* at a position which is spaced inwardly from the end margin of the last aperture on each side of the carrier device 20 so that the strip 86, 86*a* is integrally joined with the remaining portion of the carrier device 20, 20*a*. The tear strips 86, 86*a* can both start at the same end of the carrier device 20, 20*a*. Alternatively, the tear strips 86, 86*a* can start at opposite ends of the carrier device 20, 20*a*. When each strip 86, 86*a* is torn along its perforation line 88, the strip 86, 86*a* remains attached to the carrier device 20, 20*a* and does not separate into a distinct, discardable device from the remainder of the carrier device 20, 20*a*.

The perforation lines 88 allow a consumer to tear the tear strips 86, 86*a* to separate the strips 86, 86*a* from its associated first portion. Once each strip 86, 86*a* is separated from its associated first portion, a very narrow, continuous web of material, which is formed from the first portion, remains and is not torn or ruptured by the tearing of the strip 86, 86*a*. The containers 22 are retained in the package array by the narrow web so as to not separate from each other. The narrow, continuous web prevents the containers 22 from becoming dislodged uncontrollably when the consumer wants to open the package 23, 23*a*. The tearing action of the strip 86, 86*a* from the remaining portion of the carrier device 20, 20*a* may form a jagged edge along the length of the web. Preferably, the width of the first portion, which later forms the narrow web after the tear strip 86, 86*a* is torn, is greater than the distance between two adjacent dots or lines in the perforation line 88, so that the strip 86, 86*a* may be removed with a minimal chance of the forces of removing the strip 86, 86*a* being directed into the apertures 46 of the carrier device 20, 20*a* prematurely.

To release the containers 22 from the carrier device 20, 20*a*, the narrow web is selectively ruptured. Since the carrier device 20, 20*a* is positioned along the side walls 24 of each of the bottles 22, the web may be selectively and easily ruptured through a leveraging of the bottles 22 against adjacent bottles 22 to break the remaining narrow web which holds the bottles 22 together in the package array.

Since the outer margins 48 of the apertures 46 in the carrier device 20, 20*a* are slightly contoured and each tear strip 86, 86*a* is linear, this creates a region of specific reduced width of the remaining web, and therefore a stress concentration and weakness to facilitate the easy rupturing of the web and removal of the containers 22 thereafter. Furthermore, since each perforation line 88 ends at a position which is spaced inwardly from the end margin of the last aperture 46, depending on the amount of force used to tear the strip 86, 86*a*, the final forces of the tearing of the strip 86, 86*a* may be directed inwardly into the aperture 46 which releases the container 22 in that aperture 46 while retaining the containers in all other apertures.

As shown in the drawings, each tear strip 86, 86*a* may include an enlarged portion 90, 90*a* at its starting end with an aperture 92, 92*a*, shown as an arrow-shape, therein. To tear the strip 86, 86*a*, the consumer grasps the enlarged portion 90, 90*a* of the strip 86, 86*a* and may place a finger through the aperture 92, 92*a* in the enlarged portion 90, 90*a* to facilitate gripping of the tear strip 86, 86*a* so that the strip 86, 86*a* can be easily torn.

The carrier devices 20, 20*a* of the present invention present several other advantages. For example, the carrier devices 20, 20*a* are sturdy while allowing a consumer to easily carry the package 23, 23*a*. The carriers devices 20, 20*a* of the present invention can be manufactured at a low cost.

While preferred embodiments of the present invention are shown and described, it is envisioned that those skilled in the art may devise various modifications of the present invention without departing from the spirit and scope of the appended claims.

The invention claimed is:

1. A package comprising:

a plurality of containers, each container having a side wall, a top and being of a predetermined height; and a plastic carrier including container engaging portions, each container engaging portion comprising bands defining apertures, said bands engaging the side walls of the containers significantly below the tops of said containers, a handle portion extending generally perpendicular to said container engaging portions, said handle portion being integral with inner margins of said container engaging portions and joining with said container engaging portions at generally a center of said container engaging portions, said handle portion having strap portions, each strap portion having legs joined together by an elbow portion, said legs being at an angle of less than 90° from each other when the package is not carried while maintaining said handle portion generally perpendicular to said container engaging portions such that an uppermost surface of said handle portion does not substantially extend above the tops of the containers, and said legs exceeding an angle of 90° from each other when said package is carried to allow said handle portion to expand upwardly so as to allow at least a portion of said handle portion to extend beyond the tops of the containers while maintaining said handle portion generally perpendicular to said container engaging portions.

2. A package as defined in claim 1, wherein said handle portion further includes a perforation line between said strap portions for separating said strap portions apart from each other so that said strap portions can generally straighten when said handle portion is expanded upwardly to extend beyond the tops of the containers.

3. A package as defined in claim 1, wherein said carrier carries six containers.

4. A package as defined in claim 1, wherein said carrier carries eight containers.

5. A package as defined in claim 1, wherein said handle portion has attachment regions for attaching an adjacent carrier thereto.

6. A package as defined in claim 5, wherein said container engaging portions have attachment regions for attaching an adjacent carrier thereto.

7. A package as defined in claim 1, wherein said handle portion further includes separating means between said strap portions for separating said handle portion when said handle portion is expanded upwardly to extend beyond the tops of the containers.

8. A package as defined in claim 7, wherein said separating means is a perforation line.

9. A flexible plastic carrier for carrying a plurality of containers comprising:

container engaging portions, each container engaging portion comprising bands defining apertures therein for holding the containers therein, a handle portion extending generally perpendicular to said container engaging portions when the containers are applied to said carrier, said handle portion including a grip portion and strap portions connecting said grip portion to said container engaging portions at generally a center of said container engaging portions, each said strap portion comprising legs joined together by an elbow portion, said legs being capable of being at an angle of less than 90° from each other when the containers are applied to said carrier while maintaining said handle portion generally perpendicular to said container engaging portions and being capable of exceeding an angle of 90° from each other when said carrier is carried with the containers therein while maintaining said handle portion generally perpendicular to said container engaging portions.

10. A carrier as defined in claim 9, wherein said carrier carries six containers.

11. A carrier as defined in claim 9, wherein said carrier carries eight containers.

12. A carrier as defined in claim 9, wherein said handle portion has attachment regions for attaching an adjacent carrier thereto.

13. A carrier as defined in claim 12, wherein said container engaging portions have attachment regions for attaching an adjacent carrier thereto.

14. A carrier as defined in claim 9, wherein said handle portion further includes separating means between said strap portions for separating said handle portion.

15. A carrier as defined in claim 14, wherein said separating means is a perforation line.

16. A carrier as defined in claim 15, wherein said carrier carries eight containers.

* * * * *